United States Patent [19]

Morales et al.

[11] 4,064,450

[45] Dec. 20, 1977

[54] ENGINE SCOPE TESTER CALIBRATOR

[75] Inventors: Michael John Morales, Whittier; George I. Reeves, Fullerton, both of Calif.

[73] Assignee: Beckman Instruments, Inc., Fullerton, Calif.

[21] Appl. No.: 707,903

[22] Filed: Aug. 16, 1976

[51] Int. Cl.[2] ..... F02P 17/00

[52] U.S. Cl. ..... 324/15; 324/16 S

[58] Field of Search ..... 324/15, 16 S, 16 R, 324/130; 328/61; 73/1 R; 307/260

[56] References Cited

U.S. PATENT DOCUMENTS 3,551,800 12/1970 Widmer ..... 324/15

*Primary Examiner*—Stanley T. Krawczewicz

*Attorney, Agent, or Firm*—Robert J. Steinmeyer; Paul R. Harder; Donald A. Streck

[57] ABSTRACT

A solid state simulator of an automobile ignition system is disclosed whereby an automotive engine scope tester can be tested and calibrated. Pulse rate logic is made responsive to means for selecting the number of cylinders and the revolutions per minute of the simulated engine. Variable pulse generation means is made responsive to the pulse rate logic. The output of the pulse generation means is used to trigger a driver connected to a conventional coil and single spark plug simulating the firing of all the spark plugs in the engine. Additionally, the output of the pulse generation means is divided and used to drive an adjustable delay which in turn triggers a one shot high voltage pulse to simulate the firing of the spark plug associated with the number one cylinder. Signal output terminals are provided at the input to the coil to indicate the time of each firing signal and allow feedback control by the engine scope tester. Sensing loops are made available for the engine scope tester pickups at the high voltage output of the coil indicating the time of firing of all the spark plugs and at the high voltage pulse circuit simulating the number one spark plug to show the time of firing thereof.

18 Claims, 4 Drawing Figures

ENGINE SCOPE TESTER CALIBRATOR

BACKGROUND OF THE INVENTION

The present invention relates to simulators, and more particularly, to a simulator simulating the ignition system of an automobile engine and which may be used in the calibration of automobile repair and maintenance equipment.

Engine scope testers have provided the modern mechanic with a powerful tool for accurately setting the ignition system of, and checking the performance of, an engine. Input leads from the scope tester are connected to various points in the ignition system to sense the electrical signals passing therethrough. Additionally, output leads are connected from the engine scope tester to the ignition system to allow the scope tester to control and override functions of the ignition system when making certain tests. Typically, one input lead to the scope tester is connected to sense the firing of the sparkplug in the cylinder designated as #1. This lead is used to trigger a tachometer indicating the engine speed in RPM on a meter on the scope tester. Additionally, this lead is used to trigger the sweep of a CRT display on the scope tester. The CRT display has a calibrated scale for the performance comparison and measurement of the various waveforms displayed thereon.

A second lead is connected to sense the high voltage lead from the coil to the center terminal on the distributor cap. A high voltage pulse passes through this lead every time a sparkplug in the engine fires. This lead is used to vertically deflect the sweep on the CRT display to give a visual representation to the ignition system under test. In one mode of operation, the engine scope tester spans the CRT display from side to side with one complete firing sequence of the engine, beginning and ending on cylinder #1. In another mode of operation, the engine scope tester displays a selected cylinder's ignition pulse across the entire CRT display. A properly operating ignition coil causes a distinctive "ringing" output on the CRT which is readily apparent to a trained mechanic. Various other display modes are also provided which allow the mechanic to measure ignition system voltages, point "dwell" and the like against the calibration markings on the CRT.

Additionally, as mentioned above, the engine scope tester is capable of controlling the ignition system to enable the mechanic to perform certain tests on the engine itself using the scope tester. A pair of leads is connected across the primary of the ignition coil under control of the engine scope tester. In normal operation, a high voltage pulse is generated in the coil by first closing the electrical path through the primary of the coil to establish a magnetic fluid. The circuit through the primary is then opened to allow the magnetic field to collapse and, thereby, induce a high voltage in the secondary of the coil. The circuit through the primary is controlled by the ignition breaker points. If the leads from the engine scope tester, being in parallel with the breaker points, maintain the circuit through the primary when the breaker points open, the firing of the sparkplug which would have fired at the time of breaker point opening can be suppressed. Since the engine scope tester is provided with an indication of the firing sequence through the input sensing the cylinder #1 lead, it can calculate the time of firing of any or all cylinders and suppress the firing of the associated sparkplug(s) by the above process. In a perfectly balanced engine in which all cylinders are contributing to the total running efficiency, the suppressing of the firing of one or more sparkplugs should have a proportional effect on the performance of the engine as measured in RPM by the tachometer on the engine scope tester. When testing the engine, the mechanic uses the engine scope tester to bypass the firing of selected cylinders. A cylinder having poor valves, rings, or the like will have a disproportionate effect on the engine speed recognizable by a trained mechanic.

Whenever an engine scope tester is repaired, tested for accuracy, or calibrated, a simulator of some sort which simulates an automobile engine's ignition system in a manner which will provide the required outputs needed as inputs by the engine scope tester, at known accurate rates, must be employed. Further, the simulator must respond to the feedback outputs of the engine scope tester to check if they are properly working and able to suppress selected sparkplug firings by an ignition system. Typically, the foregoing functions involve the use of a motor driven distributor connected to a number of spark plugs. In other words, the normal components of an automobile engine ignition system are artificially driven with a motor and connected to an appropriate DC power source, be it rectified AC or an actual lead storage automobile battery. Such mechanical devices have a number of disadvantages, not the least of which is their size and noise. They do not respond completely to the feedback of the engine scope tester. Moreover, they do not combine both a simulator and a calibrator into a single unit. Additionally, separate provision must be made for 8 cylinder, 6 cylinder, 4 cylinder, and rotary engines.

It is an object of the present invention, therefore, to provide an engine scope tester calibrator of solid state construction, providng outputs and inputs of known accuracy and faithfully duplicating the performance of an engine ignition system for an engine scope tester to interface with when testing and calibrating apparatus and functions such as a tachometer, dwell, voltage measurements, sparkplug firing suppression and a timing light. Such apparatus also should be capable of appearing as an 8 cylinder engine or as a 6 cylinder, 4 cylinder or rotary engine.

SUMMARY

The objectives of the present invention are attained by the use of solid state pulse generation apparatus. Input means are provided for the operator to select the number of cylinders and speed of operation of the engine to be simulated. Pulse rate logic is connected to these inputs and made responsive thereto. Variable pulse generation means is connected to and controlled by the pulse rate logic. The variable pulse generation means outputs a first series of pulses equal in rate to the total number of spark plug firings in an engine of the selected number of cylinders revolving at the selected speed. The first series of pulses is used to trigger a driver connected to a conventional coil an spark plug. Additionally, the first series of pulses is divided by the number of cylinders selected to provide a second series of pulses at a rate equal to the rate of firing of a single spark plug in the engine being simulated. Appropriate output means are provided to make these various pulses and signals available to an operator for connection as inputs to engine scope testers. Input means for connecting feedback leads from an engine scope tester are provided.

DESCRIPTION OF THE PREFERRED EMBODIMENT

Figure 1:
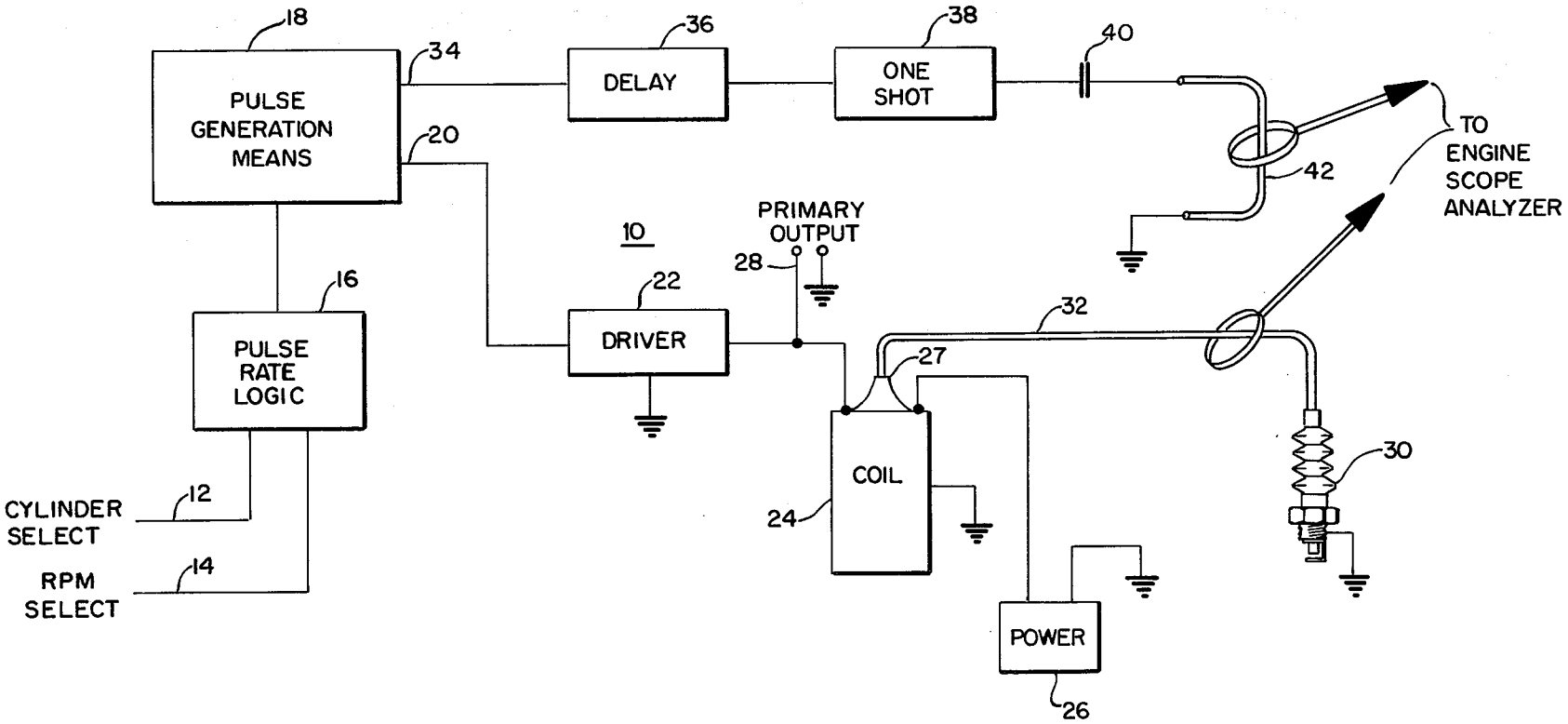
FIG. 1 is a block diagram showing a general approach to the simulation system of the present invention.

Referring to FIG. 1, an engine simulation circuit generally indicated as 10 is disclosed. Cylinder select means 12 and RPM selector means 14 are provided whereby the operator can select the number of cylinders in the engine to be simulated and the RPM at which the engine is revolving. cylinder select means 12 and RPM select means 14 are connected to pulse rate logic 16 which in turn is connected to pulse generation means 18. Pulse generation means 18 has two outputs. The first output 20 provides a series of first pulses occurring at a rate equal to the total number of spark firings occurring from all spark plugs in an engine running at the selected RPM and containing the selected number of cylinders. Thus, if an 8 cylinder engine and 3,000 RPM were selected, the rate of first pulses occurring at first output 20 of pulse generation means 18 would be 12,000 pulses per minute. First output 20 is connected to driver 22. Driver 22 performs the same gating and switching function as a transistorized ignition system in an automobile. That is, it contains a high power transistor which is connected in the primary circuit of a coil producing a high voltage. The transistor controls the high amperage current flowing through the primary of the coil (previously controlled by breakr points) by means of a low amperage signal to the transistor. A conventional automobile coil 24 is included in the preferred embodiment in order to provide the using mechanic with a display on the CRT of the engine scope tester which corresponds to that which would be seen when testing an actual engine. The primary of the coil is connected on one side to an appropriate source of DC power 26, which can be a battery or rectified AC. The other side of the primary of coil 24 is conneced to the output of driver 22. When a first pulse is received from pulse generation means 18 by driver 22, the circuit through coil 24 from power supply 26 is completed. When the first pulse passes, driver 22 disconnects the circuit through coil 24, the magnetic field created therein collapses, and a high voltage pulse is created at the high voltage output 27 of coil 24. The output of driver 22 is also connected to a pair of primary output terminals 28 made available to the engine scope tester so that the voltage of the control pulse occurring at the primary of coil 24 can be used or measured if desired. Additionally, the engine scope tester uses terminals 28 as a feedback input point for overriding driver 22. The engine scope tester bypasses the switching function of driver 22 during certain tests to prevent the firing of selected spark plugs in the simulated firing sequence by maintaining the circuit through the primary of coil 24. The high voltage output 27 is connected to spark plug 30 with a conventional spark plug wire 32. A portion of spark plug wire 32 is made available so that the high voltage pulse occurring in spark plug wire 32 can be sensed by appropriate input means of the engine scope tester using the simulator. The input means of the engine scope tester is most often a magnetic inductance probe placed around spark plug wire 32.

A second output 34 from pulse generation means 18 provides a series of second pulses corresponding to the rate of firing of one spark plug in the simulated engine. Thus, in the same example as cited previously (8 cylinders and 3,000 RPM), the second pulses occurring at second output 34 would be at the rate of 1,500 pulses per minute.

In an actual automoble engine, there is a finite delay between the time when the input to the primary is opened to cause the collapse of the magnetic field of the coil and the time when the spark resulting therefrom occurs in the spark plug. This delay may be anywhere from 10 to 100 microseconds depending on such factors as wire resistance and the gap across which the spark must jump. To accurately simulate this delay, second output 34 of pulse generation means 18 is connected to a delay circuit 36. Delay circuit 36 is connected to a one shot high voltage pulse circuit 38. Pulse circuit 38 is connected through a capacitor 40 to a conventional spark plug wire 42, a portion of which is made available, as with spark plug wire 32, for sensing as another required input by the engine scope tester. In the preferred embodiment, appropriate means (not shown) are provided within delay circuit 36 for adjusting the time of delay. In this manner, delay circuit 36 can be initially adjusted to provide the simulated spark at spark plug wire 42 at the precise moment desired. This is a factory type adjustment, and once made, would not normally require adjustment by the operator. Note that a coil and spark plug are not required for this circuit as it provides a triggering function only which is not displayed on the CRT.

An engine scope tester, when connected to an actual engine, has one lead sensing the high voltage pulses occurring in the wire connecting the high voltage output of the coil to the center post of the distributor. This input is used in the vertical deflection circuit to display the cylinder firings on the tester's CRT. A second lead is connected to sense the high voltage pulse occurring in the wire to one spark plug. This input triggers not only the tachometer circuit, but also the CRT sweep, and indicates a known point in the firing order for synchronizing the CRT display and the scope tester feedback functions. Normally, this latter signal is taken from the wire connected to the spark plug associated with cylinder No. 1. Since this input is accurately firing at a rate corresponding to a known RPM of an engine having the selected number of cylinders, the tachometer can be checked for accuracy and be recalibrated if necessary. When an engine scope tester is connected for calibration and/or testing to the simulator as described in connection with FIG. 1, the first signal thus described is taken from spark plug wire 32 and the second signal from spark plug wire 42. A more detailed diagram of an embodiment of the present invention as actually constructed and tested is set forth in FIG. 2.

Figure 2:
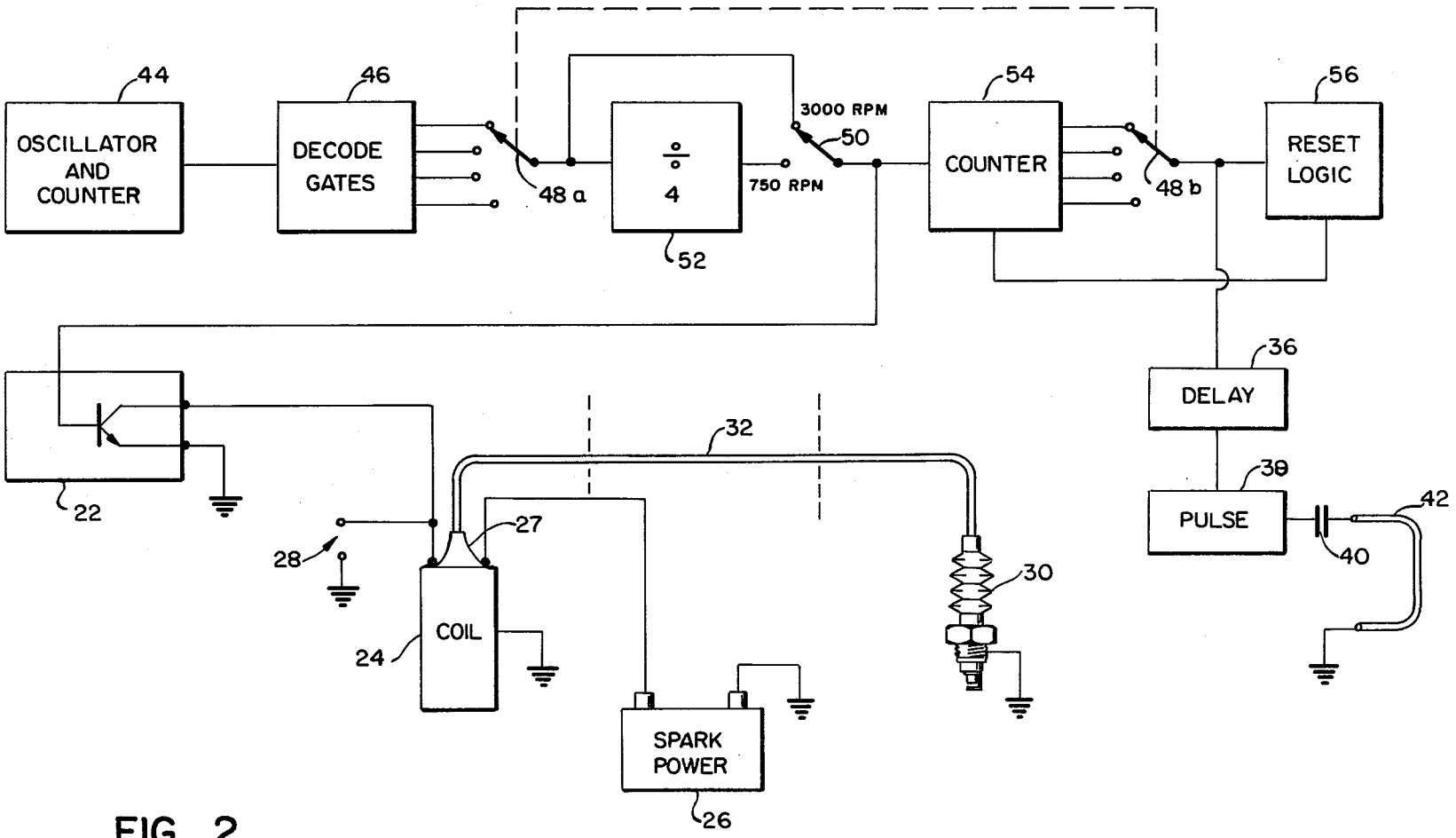
FIG. 2 is a block diagram showing a specific tested embodiment of the simulation system of the present invention.

In FIG. 2, an oscillator and counter 44 is provided, the output of which is a series of pulses occurring at the rate of 12,000 per minute. 12,000 represents the maximum total spark rate of an eight cylinder engine revolving at the top speed to be simulated, 3,000 RPM. Oscillator and counter 44 is connected to decode gates 46 having outputs of 12,000, 9,000, 6,000, and 3,000 pulses per minute; corresponding to the maximum total spark rates in eight cylinder, six cylinder, four cylinder and rotary engines respectively revolving at 3,000 RPM. The four outputs of decode gates 46 are connected to four terminals of tandem switch 48*a*, 48*b*. The movable contact of switch 48*a* is connected directly to one terminal of two position switch 50 and through a divide-by-four circuit 52 to the second terminal of switch 50. The divide-by-four circuit rescales the pulse rate when 750 RPM is selected. The movable contact of switch 50 is connected to a counter 54. Counter 54 has four outputs connected to the four terminals of the "*b*" portion of four position tandem switch 48. The four outputs of counter 54 correspond to one pulse every eight input pulses, every six pulses, every four pulses, and every other input pulse; being the firing rate of a single spark plug in eight cylinder, six cylinder, four cylinder, and rotary engines respectively. Thus, with the switches 48*a*, 48*b* and 50 positioned as shown in FIG. 2, 12,000 pulses per minute would appear at the terminal marked "8" (for a 8 cylinder engine) of switch 48*a*; 12,000 pulses per minute would occur at the selected terminal marked 3,000 RPM of switch 50 and 3,000 pulses per minute would appear at the nonselected terminal marked 750 RPM of switch 50. The 12,000 pulses per minute would be picked up by the movable contact of switch 50 and be passed on to counter 54 where 1,500 pulses per minute would be picked up from the position marked "8" of switch 48*b* by the movable contact thereof. Should the movable contact of switch 50 be shifted to the 750 RPM position with conditions otherwise remaining as just described, the 3,000 pulses per minute occurring at terminal marked 750 RPM would be picked up by the movable contact of switch 50 and passed on to counter 54 where 375 pulses per minute would now be sensed at the terminal marked "8" of switch 48*b*. The movable contact of switch 48*b* is connected to reset logic 56 which in turn feeds back to counter 54 to reset the counter each time an output pulse occurs at the selected input in order to keep counter 54 in synchronism with the type of engine being simulated. If counter 54 were allowed to run in a free running mode, actions and responses depending on the number of cylinders selected could not be incorporated into the simulator. The movable contact of switch 48*b* is also connected through delay circuit 36 to pulse circuit 38 which supplies a pulse to spark plug wire 42 through capacitor 40 as previously described in relation to FIG. 1. Likewise, the movable contact of switch 50 is connected to driver 22 which is connected to coil 24 and primary output terminals 28; coil 24 being connected to power supply 26 and further connected from its high voltage output 27 to spark plug 30 through spark plug wire 32 also as described in relationship to FIG. 1.

Figure 3:
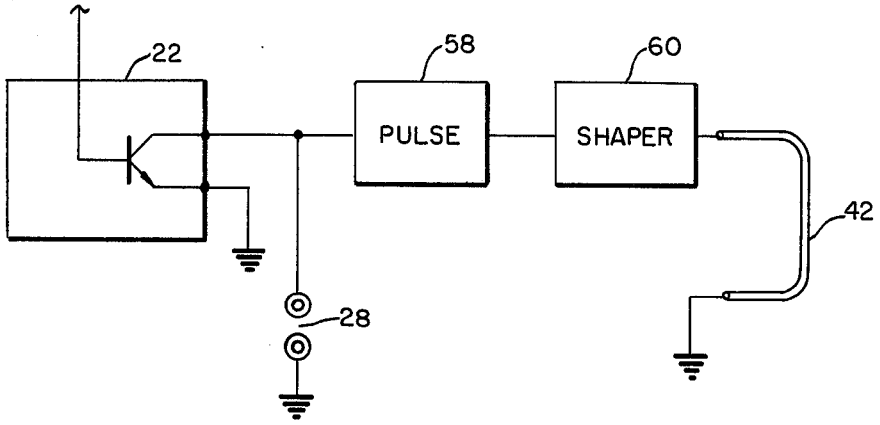
FIG. 3 is an alternate embodiment for a portion of the circuit of FIG. 2 wherein the conventional automobile coil and spark plug are replaced by simulation circuitry.

Referring to FIG. 3, an alternate embodiment is shown for replacing the coil 24, spark plug 30, and power supply 26. As was mentioned in relation to the preferred embodiment, as described in general in FIG. 1 and the constructed version thereof set forth in FIG. 2, the coil 24 and spark plug 30 are used because they provide a display on the engine scope tester CRT identical with that to be seen by the operator when using the engine scope tester on an actual engine. In addition, the coil 24 and spark plug 30 offer the advantage of being inexpensive and readily available. The important thing to provide, however, is the characteristic ringing mode display on the CRT caused by a coil as the magnetic flux collapses. This can be simulated by the circuitry of FIG. 3 wherein a pulse circuit 58 responds to the pulses from driver 22 and produces a single high voltage pulse output for each pulse from driver 22 in the same manner as the coil 24. A shaping circuit 60 of conventional design as is well known in the art may be provided between pulse circuit 58 and spark plug wire 32 to shape the pulse as delivered from pulse circuit 58 into the desired ringing shape before delivering it to spark plug wire 42 to be sensed by the engine analyzer and displayed on the CRT.

Figure 4:
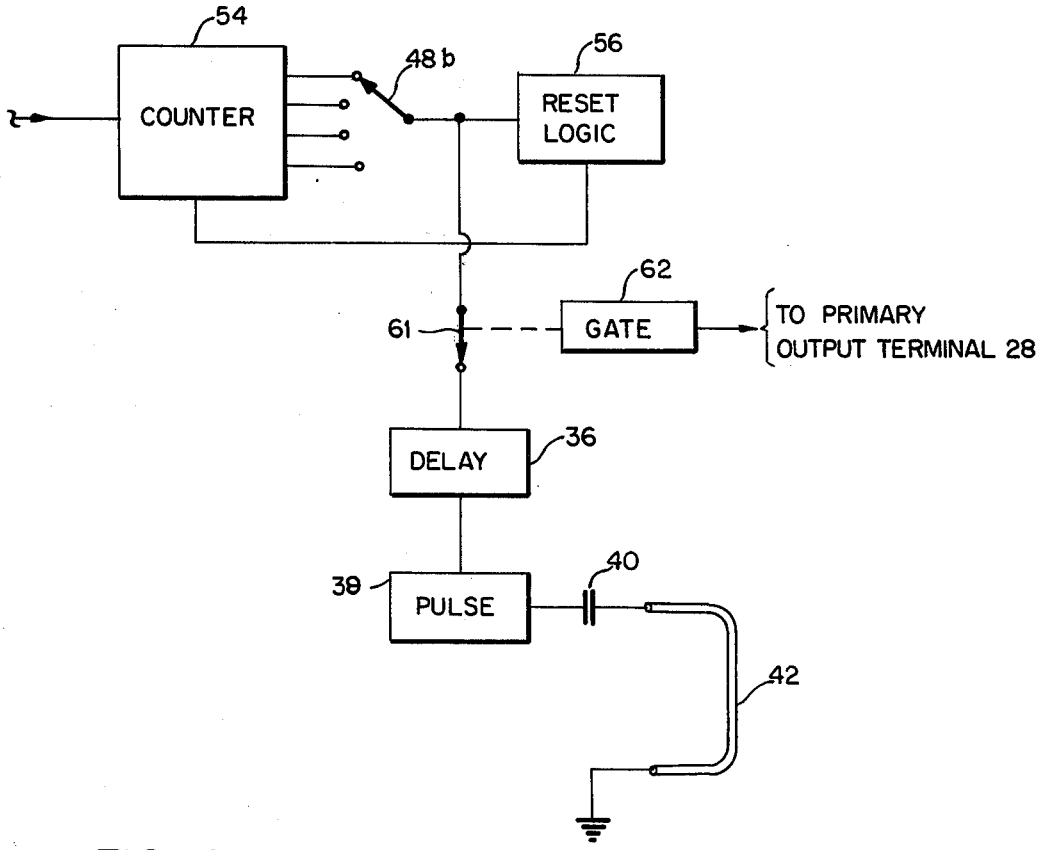
FIG. 4 is an alternate embodiment for a portion of the circuit of FIG. 2 wherein the portion simulating the actual time of firing of the spark plug is adapted to be disconnected when the engine scope tester being calibrated shorts out the spark plug being sensed as the tachometer input by the engine scope tester.

In FIG. 4, optional additional switching logic is shown connected into the line between the movable contact of switch 48*b* and delay circuit 36. Normally closed switch 61 is inserted in this line and is driven by gate 62. Gate 62 is connected to primary output terminals 28 and determines when firing of the spark plug being sensed as the trigger input of the engine scope tester is also being suppressed by the engine scope tester. The additional circuitry of FIG. 4 is only necessary when a simulation of the engine is required to be authentic in all details. Its body function is to cause the tachometer of the engine scope tester to fall to zero when the sensed spark plug triggering the tachometer and the suppressed spark plug are identical, as would be the case in an actual engine.

Having thus described our invention, we claim:

1. An engine simulator comprising:
   a. first solid-state pulse generating means for producing a series of first pulses corresponding to the firing commands to the spark plugs of an engine having a selected number of cylinders and revolving at a selected speed;
   b. means connected to said first pulse generating means for producing a first high voltage pulse in response to each of said first pulses and having means to which apparatus using the engine simulator may be connected to sense said first high voltage pulses;
   c. second solid-state pulse generating means connected to said first pulse generating means for producing a series of second pulses in synchronizaton with said first pulses and corresponding to the firing commands to an individual spark plug of the engine; and,
   d. means connected to said second pulse generating means for producing a second high voltage pulse in response to each of said second pulses and having means to which apparatus using the engine simulator may be connected to sense said second high voltage pulses.

2. An engine simulator as claimed in claim 1 and additionally comprising:
   means for selecting the number of cylinders in the engine being simulated.

3. An engine simulator as claimed in claim 1 and additionally comprising:
   means for selecting the speed of revolution of the engine being simulated.

4. An engine simulator as claimed in claim 1 wherein:
   said means for producing said second high voltage pulses includes means for delaying each of said second high voltage pulses to a time after the occurrence of said second pulse that triggered said second high voltage pulse whereby said second high voltage pulse will more nearly occur at the time when an actual spark would appear in a spark plug in an actual engine configured like the engine being simulated.

5. An engine simulator as claimed in claim 4 wherein: said delay is between 10 and 100 microseconds.

6. An engine simulator as claimed in claim 1 wherein said means for producing first voltage pulses comprises:

a. a coil having a primary and a high voltage output;
b. a source of DC power connected to one side of said primary;
c. a spark plug wire connected at one end to said high voltage output;
d. a spark plug connected to the other end of said spark plug wire and operably mounted to provide a complete circuit for a high voltage pulse crossing the gap thereof; and,
e. a driver connected to said means for generating first pulses and to the other side of said primary, said driver being adapted to complete the circuit through said primary to said power supply in response to and for the duration of each of said first pulses whereby the magnetic field of the coil will be established during a first pulse and will collapse after said first pulse has passed thereby causing a high voltage pulse at said high voltage output.

7. An engine simulator as claimed in claim 1 wherein said means for producing first high voltage pulses comprises:

a. a driver connected to said first pulse generating means and responsive to said first pulses;
b. a means connected to said driver for producing a high voltage pulse in response to each of said first pulses;
c. means connected to said last named means for shaping said high voltage pulse to appear as if produced by a coil; and,
d. means for conducting said shaped high voltage pulses from said shaping means whereby said shaped high voltage pulses can be sensed by apparatus using the engine simulator.

8. An engine simulator comprising:

a. means for selecting the number of cylinders in the simulated engine;
b. means for selecting the speed of revolution of the simulated engine;
c. pulse rate logic means connected to said cylinder selecting means and said speed selecting means for determining the rate of total spark plug firings in an engine of the selected number of cylinders revolving at the selected speed;
d. pulse generation means connected to said pulse rate logic means for generating a series of first pulses equal to the rate of total spark plug firings determined by said pulse rate logic means and a series of second pulses equal to the rate of firing of a single spark plug in the engine;
e. driver means connected to said pulse generation means and responsive to said first pulses;
f. means connected to said driver means for producing a first high voltage pulse in response to each of said first pulses; and,
g. means connected to said pulse generation means and being responsive to said second pulses for producing a second high voltage pulse in response to each of said second pulses.

9. An engine simulator as claimed in claim 8 wherein:

a. said means for producing first high voltage pulses includes means for overriding said driver means in response to an external signal whereby a first high voltage pulse will not be produced while said driver means is overriden; and,
b. said means for producing first high voltage pulses includes means for receiving an external signal indicating said driver means should be overriden.

10. An engine simulator as claimed in claim 8 wherein:

said means for producing second high voltage pulses includes means for causing a delay between the time of occurence of one of said second pulses and the time of occurrence of said second high voltage pulse produced in response thereto.

11. An engine simulator as claimed in claim 10 wherein:

said delay is between 10 and 100 microseconds.

12. An engine simulator as claimed in claim 8 wherein said means for producing first high voltage pulses comprises:

a. an automotive coil having a primary winding and a secondary winding wherein the applying and removing of a voltage across said primary winding will cause a high voltage pulse to be produced by said secondary winding;
b. a source of DC power connected in series to said primary winding and said driver means whereby said gate and switching driver means can open and close the circuit from said source of DC power and said primary winding; and,
c. a conductor path connected to said secondary winding for said high voltage pulse to travel when produced, said conductor path containing a gap therein.

13. An engine simulator as claimed in claim 8 wherein said means for producing first high volage pulses comprises:

a. means connected to said driver means for producing a high voltage pulse;
b. means connected to said high voltage pulse producing means for shaping said voltage pulse to appear as if produced by a coil; and,
c. means connected to said means for shaping for presenting said shaped high voltage pulse to a sensor.

14. An engine simulator comprising:

a. an oscillator and counter producing a series of pulses occurring at a basic rate equal to the rate of total spark plug firings in an eight cylinder engine revolving at the maximum number of RPM's to be simulated;
b. a decode gate connected to said oscillator and counter, said decode gate having four outputs, the first of said outputs being said pulses at said basic rate, the second, third and fourth of said outputs being pulses at three-fourths, one-half, and one-fourth of said basic rate respectively;
c. first switch means adapted to be selectively connected by an operator to one of said outputs of said decode gate at a time;
d. means connected to said first switch means for rescaling the rate of said pulses as a function of engine RPM to be simulated, said rescaling means having an input, an output and means for an operator to select the desired engine RPM;

e. a counter connected to said output of said rescaling means, said counter having first, second, third and fourth outputs being pulses at one-eighth, input rate to said counter, the second of said outputs being one-sixth, one-fourth and one-half the input rate to said counter respectively;

f. second switch means connected to said outputs of said counter, said second switch means being adapted to move in positional synchronization with said first switch means and selectively connect to one of said output of said counter at a time;

g. means connected to said first switch means for producing a first high voltage pulse in response to each of said pulses received from said first switch means; and, h. means connected to said second switch means for producing a second high voltage pulse in response to each of said pulses received from said second switch means.

15. An engine simulator as claimed in claim 14 and additionally comprising:

reset logic connected to said second switch means and said counter for resetting said counter when said counter has sequenced through the number of cylinders in the simulated engine as selected by said second switch.

16. An engine simulator as claimed in claim 14 wherein:

said means for producing said second high voltage pulses includes means for causing a delay between the receipt of a pulse from said second switch means and the production of one of said second high voltage pulses in response thereto.

17. An engine simulator as claimed in claim 16 wherein:

said delay is between 10 and 100 microseconds.

18. An engine simulator as claimed in claim 14 wherein said means for producing first high voltage pulses comprises:

a. a solid state switching system having an input terminal and an output terminal, said input terminal being connected to said first switch means;

b. an automotive coil of the type having a primary terminal, a battery terminal and a high voltage output, said primary terminal being connected to said output terminal of said solid state switching system whereby said solid state switching system can open and close the circuit through the primary winding of said coil;

c. a source of DC power connected to said battery terminal of said coil;

d. a spark plug wire connected on one end to said high voltage output of said coil; and, e. a spark plug connected to the other end of said spark plug wire and mounted to provide a circuit path for a high voltage pulse.

* * * * *

UNITED STATES PATENT AND TRADEMARK OFFICE

CERTIFICATE OF CORRECTION

PATENT NO. : 4,064,450

DATED : December 20, 1977

INVENTOR(S) : Michael John Morales and George I. Reeves

It is certified that error appears in the above-identified patent and that said Letters Patent are hereby corrected as shown below:

| | |
|---|---|
| Column 8, line 40, | "volage" should be deleted and the word --voltage-- should be inserted. |
| Column 8, line 45, | after "said" the word --high-- should be inserted. |

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*